US010287836B2

(12) United States Patent
Walters et al.

(10) Patent No.: US 10,287,836 B2
(45) Date of Patent: May 14, 2019

(54) TUBING REMOVAL SYSTEM

(71) Applicant: Halliburton Energy Services, Inc., Houston, TX (US)

(72) Inventors: Darren Philip Walters, Tomball, TX (US); Kevin Scott Harive, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 12 days.

(21) Appl. No.: 15/519,422

(22) PCT Filed: Dec. 3, 2015

(86) PCT No.: PCT/US2015/063647
§ 371 (c)(1),
(2) Date: Apr. 14, 2017

(87) PCT Pub. No.: WO2017/095410
PCT Pub. Date: Jun. 8, 2017

(65) Prior Publication Data

US 2018/0087339 A1 Mar. 29, 2018

(51) Int. Cl.

| | |
|---|---|
| ***E21B 29/02*** | (2006.01) |
| ***E21B 29/00*** | (2006.01) |
| ***E21B 43/114*** | (2006.01) |
| *E21B 33/13* | (2006.01) |

(52) U.S. Cl.
CPC ..... *E21B 29/02* (2013.01); *E21B 29/005* (2013.01); *E21B 43/114* (2013.01); *E21B 33/13* (2013.01)

(58) Field of Classification Search
None
See application file for complete search history.

(56) References Cited

U.S. PATENT DOCUMENTS

| | | | | |
|---|---|---|---|---|
| 4,074,756 | A | 2/1978 | Cooke, Jr. | |
| 4,378,844 | A * | 4/1983 | Parrish | F42D 1/04 102/313 |
| 4,479,556 | A | 10/1984 | Stout et al. | |
| 4,541,486 | A | 9/1985 | Wetzel et al. | |
| 5,509,480 | A | 4/1996 | Terrell et al. | |
| 5,542,480 | A | 8/1996 | Owen et al. | |
| 5,638,901 | A | 6/1997 | Shirley et al. | |

(Continued)

FOREIGN PATENT DOCUMENTS

GB 2305683 A 4/1997

OTHER PUBLICATIONS

International Search Report and the Written Opinion of the International Search Authority, or the Declaration, dated Sep. 7, 2016, PCT/US2015/063647, 15 pages, ISA/KR.

*Primary Examiner* — William D Hutton, Jr.
*Assistant Examiner* — Charles R Nold
(74) *Attorney, Agent, or Firm* — Haynes and Boone, LLP

(57) ABSTRACT

Example apparatus, methods, and systems described for cutting tubulars in a downhole environment. In an example apparatus, energetic cutters are housed within a carrier. In some embodiments, the carrier is a cylindrical, tubular member. Radial energetic cutters are positioned at the ends of the carrier and linear energetic cutters are positioned between the radial energetic cutters. Initiation of the energetic cutters results in tubular fragments that fall downhole.

17 Claims, 5 Drawing Sheets

(56) References Cited

U.S. PATENT DOCUMENTS

| | | | | |
|---|---|---|---|---|
| 5,720,344 | A * | 2/1998 | Newman | E21B 29/02 166/253.1 |
| 7,104,326 | B2 * | 9/2006 | Grattan | E21B 29/02 102/320 |
| 7,779,760 | B2 * | 8/2010 | Konig | E21B 43/118 102/306 |
| 2006/0075888 | A1 * | 4/2006 | Yang | F42B 3/08 89/1.14 |
| 2007/0251692 | A1 | 11/2007 | Billingham | |
| 2012/0279706 | A1 | 11/2012 | Solversen et al. | |
| 2014/0182853 | A1 | 7/2014 | Nikiforuk | |
| 2014/0224500 | A1 | 8/2014 | Wilie et al. | |
| 2014/0311741 | A1 | 10/2014 | Tunget | |
| 2015/0144340 | A1 | 5/2015 | Surjaatmadja et al. | |
| 2015/0233219 | A1 * | 8/2015 | Bell | E21B 43/117 89/1.15 |

* cited by examiner

TUBING REMOVAL SYSTEM

PRIORITY

The present application is a U.S. National Stage patent application of International Patent Application No. PCT/US2015/063647, filed on Dec. 3, 2015, the benefit of which is claimed and the disclosure of which is incorporated herein by reference in its entirety.

BACKGROUND

After an oil or gas well is drilled, it may become desirable to abandon the well if production is no longer possible or economical. It is common practice to plug the well before abandonment to close zones and prevent migration of hydrocarbon fluids. Plugging may be achieved by injecting a settable substance, such as cement, into the well. For example, a well will sometimes have production perforations in production tubing and/or casing of the well, through which hydrocarbons enter from the surrounding formations and travel to the surface. Pulling production tubing and casing out of the well during abandonment is often expensive due to rig use or may not be possible due to rig unavailability. Some plug and abandonment operations leave casing in place by sealing production perforations with cement to form a flow barrier to prevent influx into the casing and flow uphole, including through any tubing present. In other examples, the casing can be perforated at a specific location before placing a cement plug across the annulus and casing. However, there can be uncertainty associated with integrity of the plug due to nature of cement and the flow area it requires to evenly spread, and therefore it can be difficult for operators to ensure that wells are adequately plugged.

DETAILED DESCRIPTION

To address some of the challenges described above, as well as others, apparatus, systems, and methods are described herein that operate to provide removal of tubing.

In example embodiments, tubing removal gun includes energetic cutters are housed within a carrier. In some embodiments, the carrier is a cylindrical, tubular member, which may be carried into the well either by wireline, or by a tubing string. The energetic cutters are constructed out of energetic materials, such as explosives or energetic metal alloys. Radial energetic cutters are positioned in spaced relation to one another, such as at the ends of the carrier, and linear energetic cutters are positioned between the radial energetic cutters. In other embodiments, radial vents for focusing the flow from energetic metal alloys are positioned in spaced relation to one another, such as at the ends of the carrier, and linear vents are positioned between the radial vents. Initiation of the energetic cutters when positioned downhole in tubing results in small sections of tubing (e.g., tubular fragments) that fall downhole. The radial energetic cutters sever the tubing, and the linear energetic cutters, cut the tubular sections into the smaller fragments that can then pass downhole. These fragments can be left downhole or retrieved by magnets if desired. Cutting of the tubing exposes a section of casing, cement, or rock face that allows for a cement plug to be placed, which can be more efficient and less costly than pulling out tubing or section milling to allow a cement plug to be set in the wellbore.

Figure 1:
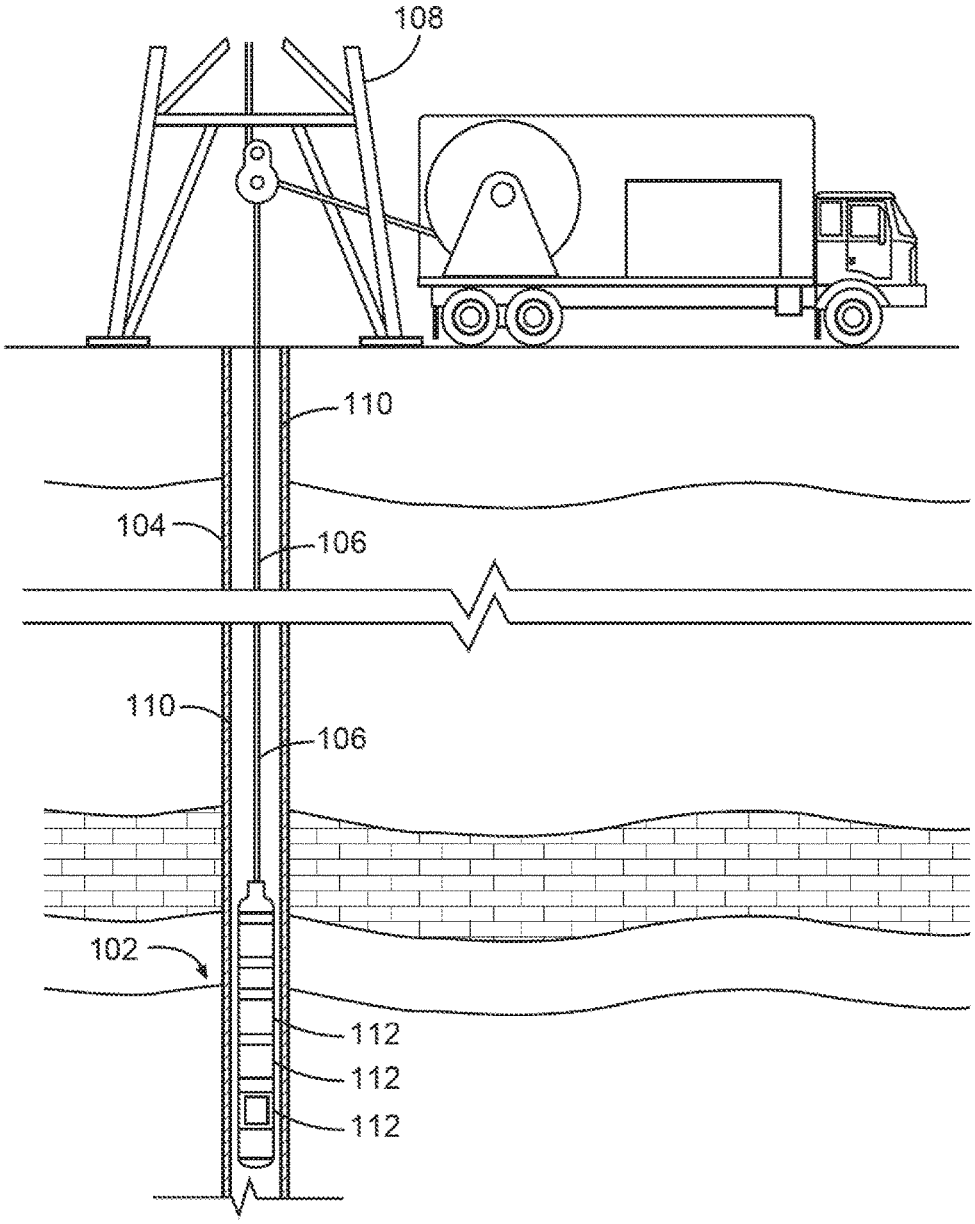
FIG. 1 is a schematic sectional view of a rig for deploying a tubing removal device, in accordance with one or more embodiments.

FIG. 1 is a schematic sectional view of a rig for deploying a tubing removal device, in accordance with one or more embodiments. A tubing removal device 102 can be suspended and run into the wellbore 104 by a wireline 106, or any other conveyance mechanism (e.g., tubing or slickline). The wireline 106 is suspended in the wellbore 104 from a rig 108. For simplicity, the following discussion will refer to a land-based site, although various embodiments are not to be limited thereto. While a land system is shown, the teachings of the present disclosure may also be utilized in platform, offshore, deepwater, or subsea applications. It should be noted that the tubing removal device 102 is not limited to being disposed on a wireline, and can also be conveyed using rigid conveyance mechanisms, such as coiled tubing or jointed drill pipe.

As shown, the tubing removal device 102 is positioned inside a production tubing 110 to a desired depth via the wireline 106. The tubing removal device 102 can include one or more sections 112 coupled together in series, each operable to cut a portion of the production tubing. Alternatively, the sections may be coupled in a desired spacing between different or multiple sections, to cut the tubing at multiple spaced locations, as may be desired. However, it should be understood that any wellbore tubular may be severed using the tubing removal device 102, e.g., casing, liner, jointed drill pipe, coiled tubing, etc. As will be described in more detail below, in some embodiments, a carrier, such as a wireline tool body, or a downhole tool, can be used to house one or more components of the tubing removal device as described in more detail below with reference to FIGS. 2-3.

As shown, the tubing removal device 102 comprises individual sections 112 assembled into a gun string. The tubing removal device 102 can be actuated by a signal, such as an electrical signal, a pressure pulse or pressure increase, a drop bar, a timer, or any other suitable mechanism.

Figure 2C:
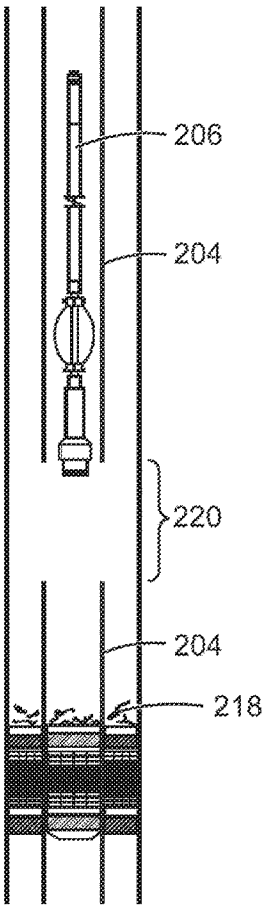
FIGS. 2A-2C are diagrams illustrating the operating of a tubing removal device, according to one or more embodiments.
Figure 2B:
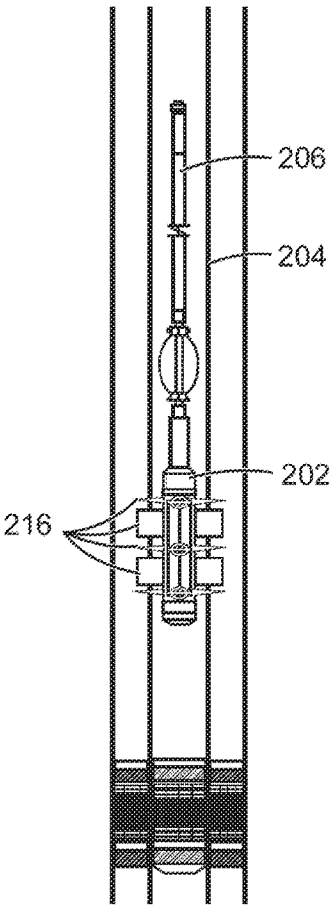
Figure 2A:
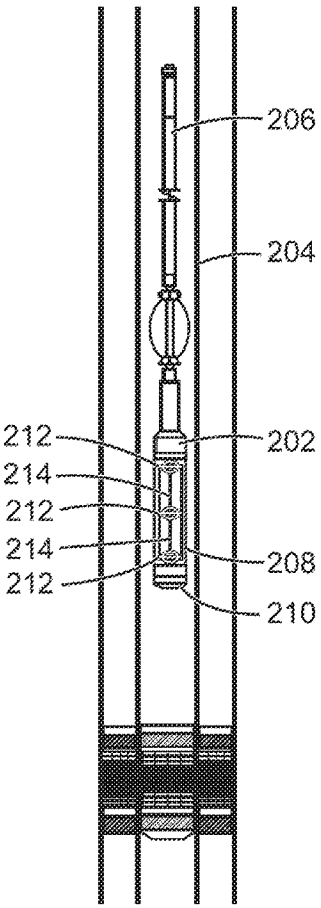

FIGS. 2A-2C illustrate diagrams of operating a tubing removal device, according to one or more embodiments. In FIG. 2A, the tubing removal device 202 is positioned inside production tubing 204 using wireline 206. The tubing removal device 202 includes a cutter assembly 208 disposed within a carrier 210. In accordance with the present invention, an embodiment of the carrier 210 can be formed as a hollow body or cylindrical sleeve using aluminum, steel, or other metallic composites. In some embodiments, the carrier 210 can be a hexagonal, octagonal, decagonal, or dodecagonal member. In other embodiments, the carrier 210 can be formed from multi-layered metallic and/or inter-metallic laminate. The materials can be formed into a tubular shape of appropriate dimensions.

The cutter assembly 208 comprises an arrangement of radial energetic cutters 212 and linear energetic cutters 214 that are disposed within the carrier 210, forming an individual gun (e.g., gun 112 from FIG. 1). The radial energetic cutters 212 and linear energetic cutters 214 are constructed from energetic materials that produce energy when activated. This energy may take the form of heat, gas, light, sound, work, or any combination thereof. Energetic materials often contain their own source of oxygen or other element capable of sustaining combustion, and do not require atmospheric oxygen for combustion. Therefore, many energetic materials will sustain combustion under water or in a vacuum. Energetic materials are classified into deflagrating energetic materials and detonating energetic materials. Deflagrating energetic materials include igniter compositions, pyrotechnics, propellants, fuels, and thermal compositions. Detonating energetic materials include explosives.

Under normal conditions, some energetic materials, such as explosives, will not burn, but they will detonate if ignited. Igniter compositions can be used to activate an energetic material. The explosive strength of igniter compositions are inferior to those of explosives, but are sufficient to activate an explosive or other energetic materials. Because of the sensitivity of igniter compositions, they can be used for initiating and intensifying explosions.

Optionally, additives can be included with the energetic material, including tungsten, magnesium, cement particles, rubber compounds, compound fibers, steel, steel alloys, zinc, and combinations thereof. Such additives can desensitize the energetic material to prevent an unplanned reaction of the material. Additionally, desensitizing additives can slow the rate of reaction of the state change of the energetic material thereby reducing localized pressure buildup during vaporization. These additives can also add strength to the energetic material. Desensitizing the material can be especially useful when portions of the tubing removal device 202 (e.g., the liner or carrier) are subjected to environments that might promote early initiation of the energetic material, such as high shock and or vibration, or an event that introduces excess temperature and/or pressure onto the energetic material.

In one embodiment, the radial energetic cutters 212 and linear energetic cutters 214 are shaped charges, explosive devices shaped to focus the effect of the explosive's energy. A shaped charge is a term of art for a device that when detonated generates a focused explosive output. This is achieved in part by the geometry of the explosive in conjunction with a liner in the explosive material.

The shaped charge contains energetic material, namely, explosive material, behind a cavity with a liner material at one end and a detonator at the other end. The cavity can be lined with various glasses and/or metals for projecting a high velocity jet of metal particles caused by pressure upon the detonation of the explosive material. Pressure generated by the explosive drives the liner in the cavity inward to collapse upon its central axis. The resulting collision forms and projects a high-velocity jet forward along the central axis.

The deepest penetrations are achieved with a dense, ductile metal such as copper. The selection of the material depends on the target to be penetrated; for example, aluminum is advantageous for concrete targets. For the deepest penetrations, pure metals yield the best results, because they display the greatest ductility and delay the breakup of the jet into particles as it stretches. Liners can also be fabricated by powder metallurgy, often of pseudo-alloys which yield jets that are comprised mainly of dispersed fine metal particles. Many materials can be used for the liner, some of the more common metals including brass, copper, tungsten, and lead.

In some embodiments, the radial energetic cutters 212 are comprised of jet cutters using a circular-shaped charge to produce the cutting action. Jet cutters are capable of severing tubulars despite significant downhole pressure, making them a good cutter choice for wellbore operations. Typically, the jet cutter is an explosive shaped charge that has a circumferential V-shaped profile. The explosive is typically combined with a liner and contained within a carrier or another similar type of housing. When the jet cutter is detonated, it will generate a jet of high velocity, typically in 360 degrees of direction, which will sever the tubular.

In some embodiments, the linear energetic cutters 214 are comprised of linear shaped charges, generally with a V-shaped profile. The liner of the linear shaped charge is surrounded with explosive, the explosive then encased within a suitable material that serves to protect the explosive and to confine it on detonation. The charge is detonated, the detonation projecting the lining to form a continuous, knife-like (e.g., planar) jet. The jet cuts any material in its path, to a depth depending on the size and materials used in the charge. It is noted that while other types of tubular cutters are available, including mechanical cutting devices and chemical cutters, the focus of this disclosure is on cutters comprised of energetic materials.

Detonation of the shaped charges in the tubing removal device 202 can be initiated from the surface by a signal via the wireline 206. In some embodiments, detonation can be initiated using pressure or from acoustic signals. In FIG. 2B, the tubing removal device 202 has been lowered to a position where cutting of the production tubing 204 is desired. Upon detonation of the shaped charges, liner metal of the shaped charges are compressed into heated, pressurized jets 216 that can penetrate concrete, rock, and metal, such as to sever the surrounding production tubing 204.

In some embodiments, the radial energetic cutters 212 and linear energetic cutters 214 are comprised of metal alloy energetic materials that transition into a hot liquid with high pressure build up. In this example, the cutter assembly 208 includes venturi (not shown) for focusing the flow of the hot liquid to conduct cuts. The venturi operates by providing a constriction in flow area that increases fluid velocity as it passes through the constriction. In this example, the radial energetic cutters 212 include a radial venturi encompassing 360 degrees of direction to sever the tubular. The linear energetic cutters 214 include linear venturi for conducting straight cuts. It is noted that the plurality of linear energetic cutters are coupled together using flow paths.

It is noted that when the radial energetic cutters 212 are activated, the resulting jets radially cut the production tubing 204. The linear energetic cutters 214, when activated, cut linearly along a longitudinal axis of the production tubing 204. By positioning linear cuts in between radial cuts, tubulars (e.g., production tubing 204) can be cut into small segments (e.g., debris 218) that free falls to the bottom of the well. As shown in FIG. 2C, an interval 220 that corresponds to the length of the tubing removal device 202 has been cut from the production tubing 204. A concrete plug can be placed at the interval 220 to plug the well for abandonment. As previously noted, the alternative of perforating tubing to place a cement plug can lead to uncertainty due to the risk of micro-annuli and risks of plug failure. By removing tubing at the point of interest (e.g., the interval 220) to allow the setting of a well constructed isolation plug, operators would save time and money by not needing to pull the tubing from the well, operations that would otherwise take multiple days to complete.

Figure 3:
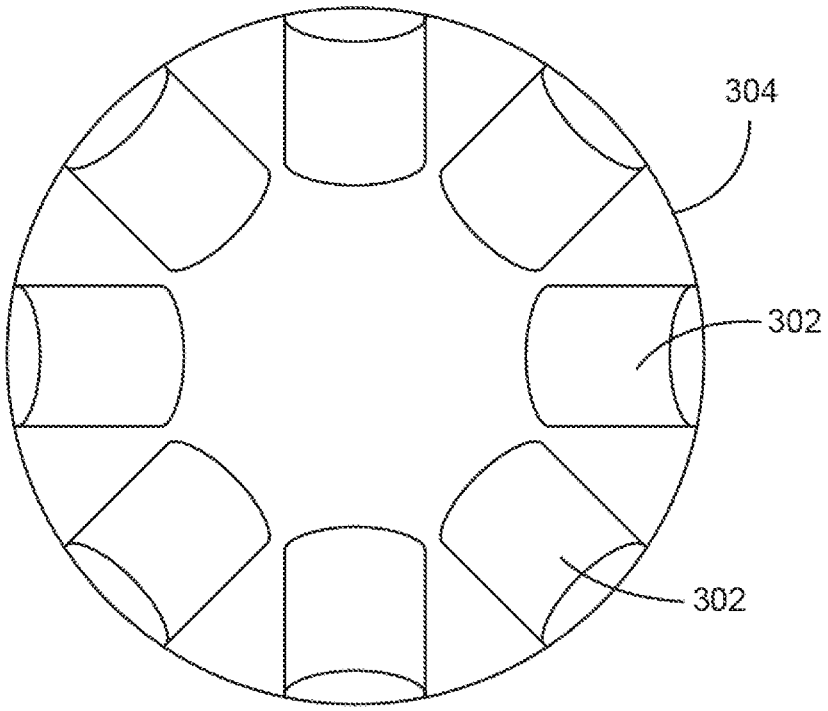
FIG. 3 is a top view of an arrangement of linear energetic cutters, according to one or more embodiments.

FIG. 3 is a top view of an arrangement of linear energetic cutters, according to one or more embodiments. A plurality of linear energetic cutters 302 (e.g., linear energetic cutters 214 from FIG. 2) are positioned within the interior of carrier 304 (e.g., carrier 210 from FIG. 2). The plurality of linear energetic cutters 302 are coupled together using detonating cord (not shown). In this example, eight total linear energetic cutters 302 are positioned approximately evenly around the inner circumference of carrier 304. In this way, when the linear energetic cutters are initiated, the resulting pieces of cut tubular are approximately the same size. Although FIG. 3 is illustrated as having a particular distribution of energetic cutters, it will be appreciated by those of ordinary skill in the art that any number of linear energetic cutters can be arranged or distributed within the carrier for cutting tubulars.

Further, although the embodiments described herein have energetic cutters (e.g., both radial and linear energetic cutters) positioned around the entire inner circumference of the carriers, it should be appreciated that total coverage is not required. In other embodiments, it is contemplated that only a portion of the carrier's inner circumference (e.g., half of the inner circumference in a semi-circle arrangement) has energetic cutters. In this way, when the energetic cutters are initiated, the resulting cut does not sever the tubing but rather, cuts out a window.

Figure 4:
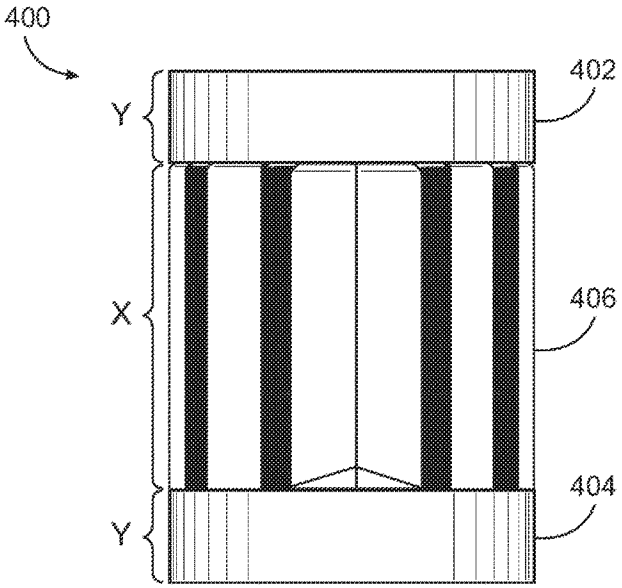
FIG. 4 is a side view of a cutter assembly with a single stack of linear cutters, according to one or more embodiments.

FIG. 4 is a side view of a cutter assembly 400 with a single stack of linear cutters, according to one or more embodiments. Cutter assembly 400 comprises an arrangement of radial energetic cutters 402, 404 and linear energetic cutters 406. The radial energetic cutters 402, 404 and linear energetic cutters 406 are constructed from energetic materials that produce energy when activated, such as discussed in relation to FIG. 2.

In one embodiment, the radial energetic cutters 402, 404 and linear energetic cutters 406 are shaped charges, explosive devices shaped to focus the effect of the explosive's energy. The radial energetic cutters 402, 404 are comprised of jet cutters using a circular-shaped charge to produce the cutting action. Typically, the jet cutter is an explosive shaped charge that has a circumferential V-shaped profile. The explosive is typically combined with a liner and contained within a carrier or another similar type of housing. When the jet cutter is detonated, it will generate a high velocity jet, typically in 360 degrees of direction. The linear energetic cutters 406 are comprised of linear shaped charges, generally with a V-shaped profile.

In this example, the radial energetic cutters 402 and 404 each have a length of Y inches. The radial energetic cutters 402 and 404 are separated from each other by linear energetic cutters 406 having a length of X inches. In the X inch gap between the radial energetic cutters are columns of linear energetic cutters 406, in an arrangement such as described in FIG. 3. When the energetic cutters of cutter assembly 400 are initiated, any surrounding tubulars will be cut into approximately X-inch long strips that will fall downhole.

It is noted that although FIG. 3 describes an arrangement of having eight linear energetic cutters, embodiments are not limited thereto. Other embodiments can have any number of linear cutters, with the arrangement of linear cutters for the sectional cuts generally dictated by size of tubing to be cut. Further, although the example of FIG. 4 illustrates an arrangement for cutting tubulars by approximately X-inches, additional lengths of tubing can be cut by either lengthening the section of linear energetic cutters or adding additional stacks of linear cutters.

Figure 5:
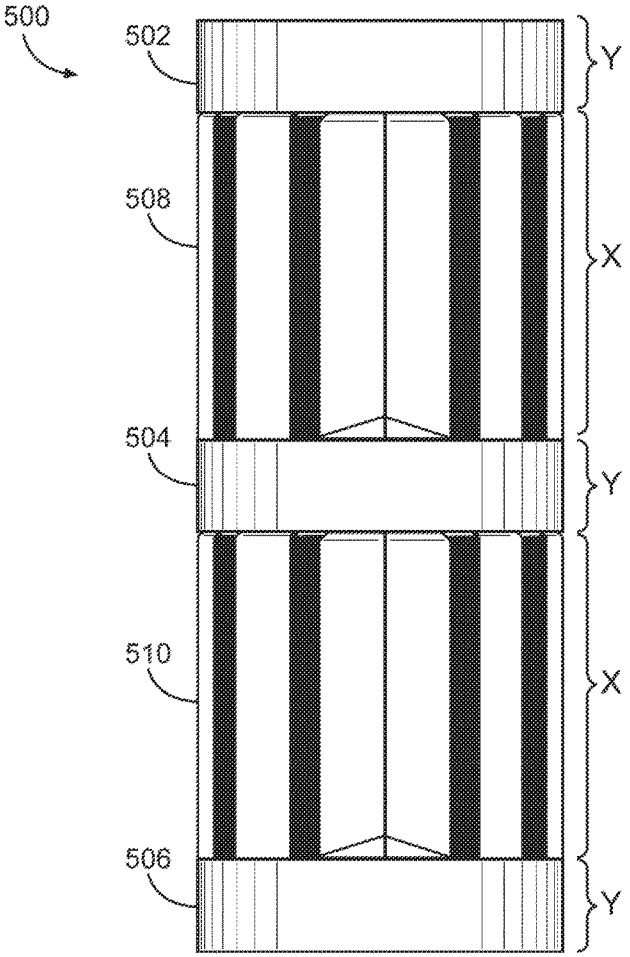
FIG. 5 is a side view of a cutter assembly with a double stack of linear cutters, according to one or more embodiments.

For example, FIG. 5 is a side view of a cutter assembly 500 with a double stack of linear cutters, according to one or more embodiments. Cutter assembly 500 comprises an arrangement of radial energetic cutters 502, 504, and 506 and linear energetic cutters 508, 510. The radial energetic cutters 502, 504, and 506 and linear energetic cutters 508, 510 are constructed from energetic materials that produce energy when activated, such as discussed in relation to FIG. 2.

In one embodiment, the radial energetic cutters 502, 504, and 506 and linear energetic cutters 508, 510 are shaped charges, explosive devices shaped to focus the effect of the explosive's energy. The radial energetic cutters 502, 504, and 506 are comprised of jet cutters using a circular-shaped charge to produce the cutting action. Typically, the jet cutter is an explosive shaped charge that has a circumferential V-shaped profile. The explosive is typically combined with a liner and contained within a carrier or another similar type of housing. When the jet cutter is detonated, it will generate a high velocity jet, typically in 360 degrees of direction. The linear energetic cutters 508, 510 are comprised of linear shaped charges, generally with a V-shaped profile.

In this example, the radial energetic cutters 502, 504, and 506 each have a length of Y inches. The radial energetic cutters 502, 504, and 506 are separated from each other by linear energetic cutters 508, 510 having lengths of X inches. In the X inch gap between the radial energetic cutters are columns of linear energetic cutters, in an arrangement such as described in FIG. 3. When the energetic cutters of cutter assembly 500 are initiated, any surrounding tubulars will be cut into approximately X-inch long strips that will fall downhole.

Figure 6:
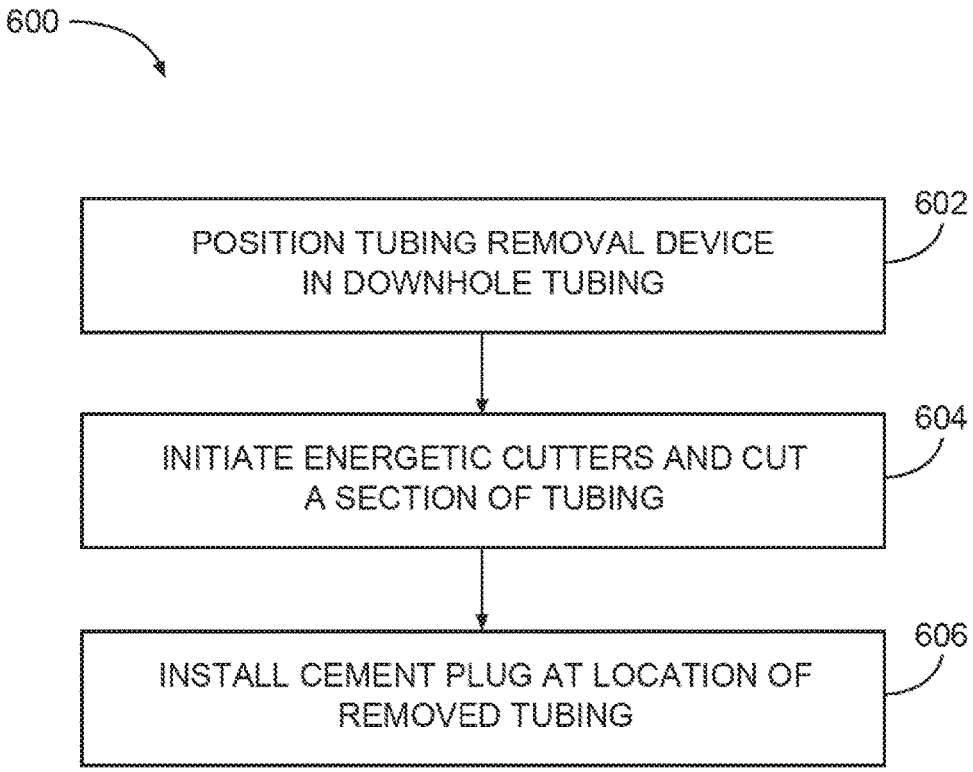
FIG. 6 is a flow diagram illustrating an example method for placing a downhole plug, according to one or more embodiments.

FIG. 6 is a flow diagram illustrating an example method 600 for placing a downhole plug, according to one or more embodiments. The example method 600 begins with operation 602 by positioning a tubing removal device 202 (FIG. 2) inside downhole tubing (e.g., production tubing 204 of FIG. 2) using wireline 206 (FIG. 2). In some embodiments, the tubing removal device is conveyed using rigid conveyance mechanisms, such as coiled tubing or jointed drill pipe. The tubing removal device houses a cutter assembly 400 (FIG. 4) that includes an arrangement of radial energetic cutters 402, 404 (FIG. 4) and linear energetic cutters 406 (FIG. 4). When positioned at the point of interest in downhole tubing, radial cutter 402 is positioned above (e.g., uphole) and radial cutter 404 is positioned below (e.g., downhole) of the section of tubing to be removed.

The example method 600 continues at operation 604 by cutting out a section of tubing using the tubing removal device. This includes horizontally cutting through the tubing using the radial cutters. For example, a 360 degree cut through the tubing is made using both radial energetic cutters. Next, vertical cuts are made using the linear energetic cutters positioned in between the radial energetic cutters to cut the section of tubing to be removed into small strips. These resulting strips of tubing typically fall downhole. These strips of tubing can be left downhole or can optionally be retrieved using a magnet.

It is noted that while the operation 604 is described as performing horizontal cuts prior to vertical cuts, it will be appreciated by those of ordinary skill in the art that the sequence in which cuts are made is not critical; vertical cuts can be performed prior to the horizontal cuts or the cuts can be performed at substantially the same time. The example method 600 concludes at operation 606 with installing a cement plug at the location in the well where the tubing was removed.

Many advantages can be gained by implementing the apparatus, methods, and systems described herein. For example, in some embodiments, downhole tubing can be cut into small fragments to expose a section of casing, cement, or rock face that allows a cement plug to be placed without having to perform perforation operations and without having to pull production tubing from the well. This saves time by providing tools for removing a window/segment of tubing mid-well without the need for milling tools. Further, the use of energetic materials for cutting prevents the contamination of fluids with metal shavings (e.g., swarf) and avoids having to circulate clean well fluids to remove metal shavings. By mitigating the metal shavings, the risk of damaging blowout preventers (BOPS) and other valves during the cleaning process is also reduce.

The tubing removal device can not only remove whole areas of pipe but can also cut large sectional windows for flow path. Multiple runs can be carried out quickly and correlated on depth for an accurate account on where windows will be cut out of the tubing. Rather than being worried about tubing punch perforations being blocked during circulation, heavy sediment buildup in the annuli near packers can be cleared using windows cut in the tubing.

These advantages can significantly enhance the value of the services provided by an operation/exploration company, helping to reduce time-related costs and increase customer satisfaction.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

Although specific embodiments have been illustrated and described herein, it will be appreciated by those of ordinary skill in the art that any arrangement that is calculated to achieve the same purpose may be substituted for the specific embodiments shown. Various embodiments use permutations or combinations of embodiments described herein.

According to aspects of the present disclosure, an apparatus may include a carrier housing (in some cases, a cylindrical member), with a first radial energetic cutter positioned at a first location, such as a first end of the carrier housing, a second radial energetic cutter positioned at a second location, in spaced relation to the first location, such as a second end of the carrier housing, and one or more linear energetic cutters positioned within the carrier housing between the first and second radial energetic cutters. In some embodiments, at least one of the first and second radial energetic cutters is a jet cutter; while in other embodiments, either or both of the first and second radial energetic cutters are constructed of explosive materials.

In some embodiments the linear energetic cutters are linear shaped charges. In some embodiments, the group of linear energetic cutters are coupled together using a detonating cord. In some embodiments, the linear energetic cutters are distributed evenly along an inner circumference of the carrier housing. In other embodiments, the linear energetic cutters are distributed along only a portion of an inner circumference of the carrier housing; while in some embodiments, the first and second radial energetic cutters extend along the entire inner circumference of the carrier housing.

According to other aspects of the present disclosure, a method may include positioning a tubing removal device in a downhole tubing, initiating the group of radial energetic cutters and generating radial cuts through the downhole tubing, and/or initiating the group of linear energetic cutters and generating linear cuts through the downhole tubing. In some embodiments, the tubing removal device may include a group of radial energetic cutters and a group of linear energetic cutters. In some embodiments, generating radial cuts through the downhole tubing may further include generating a 360 degree radial cut through the downhole tubing. In some embodiments, generating linear cuts through the downhole tubing may further include generating linear cuts along a longitudinal length of the downhole tubing.

In some embodiments, the result of the radial and linear cuts is to sever a segment of tubing from the downhole tubing at a position of interest. In some embodiments, the radial and linear cuts generate a window in the downhole tubing at a position of interest. Some methods will further include setting a concrete plug at the position of interest.

In some embodiments, a method may include positioning a tubing removal device in a downhole tubing, initiating the group of radial energetic cutters and generating radial cuts through the downhole tubing, and initiating the group of linear energetic cutters and generating linear cuts through the downhole tubing. According to aspects of the present disclosure, the tubing removal device may include a group of radial energetic cutters and a group of linear energetic cutters. In some embodiments, generating radial cuts through the downhole tubing may further include generating a 360 degree radial cut through the downhole tubing. In some embodiments, generating linear cuts through the downhole tubing may further include generating linear cuts along a longitudinal length of the downhole tubing.

In some embodiments, the radial and linear cuts sever a segment of tubing from the downhole tubing at a position of interest. In some embodiments, such a method may further include setting a concrete plug at the position of interest. In some embodiments, the radial and linear cuts generate a window in the downhole tubing at a position of interest.

It is to be understood that the above description is therefore intended to be illustrative, and not restrictive, and that the phraseology or terminology employed herein is for the purpose of description. Combinations of the above embodiments and other embodiments will be apparent to those of ordinary skill in the art upon studying the above description.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

What is claimed is:

1. An apparatus for severing downhole tubing to form a plurality of tubing strips, comprising:

a carrier housing sized to extend within the downhole tubing;

a first radial energetic cutter positioned at a first end of the carrier housing and configured to make a first radial cut in the downhole tubing;

a second radial energetic cutter positioned at a second end of the carrier housing and spaced from the first radial energetic cutter by a predetermined amount wherein the second radial energetic cutter is configured to make a second radial cut in the downhole tubing; and a plurality of linear energetic cutters positioned within the carrier housing between the first and second radial energetic cutters and configured to make a plurality of longitudinal cuts in the downhole tubing;

wherein each of the first radial energetic cutter and the second radial energetic cutter comprises deflagrating energetic material and/or detonating energetic material; and wherein, when initiated, the first radial energetic cutter, the second radial energetic cutter, and the plurality of linear energetic cutters sever the downhole tubing to form the plurality of tubing strips.

2. The apparatus of claim 1, wherein at least one of the first and second radial energetic cutters is a jet cutter.

3. The apparatus of claim 1, wherein the plurality of linear energetic cutters are coupled together using a detonating cord.

4. The apparatus of claim 1, wherein at least one of the first and second radial energetic cutters is constructed of non-explosive materials.

5. The apparatus of claim 1, wherein the linear energetic cutters are distributed evenly along an inner circumference of the carrier housing.

6. The apparatus of claim 1, wherein the linear energetic cutters are distributed along only a portion of an inner circumference of the carrier housing.

7. The apparatus of claim 1, wherein the first and second radial energetic cutters extend along the entire inner circumference of the carrier housing.

8. The apparatus of claim 1, wherein the first and second radial energetic cutters extend along only a portion of an inner circumference of the carrier housing.

9. The apparatus of claim 1, wherein the tubing strips have a length that is associated with the predetermined amount.

10. A method, comprising:

positioning a tubing removal device in a downhole tubing, wherein the tubing removal device comprises a plurality of radial energetic cutters and a plurality of linear energetic cutters; and severing the downhole tubing at a position of interest to form a plurality of tubing strips;

wherein severing the downhole tubing comprises:

initiating the plurality of radial energetic cutters to make radial cuts through the downhole tubing; and initiating the plurality of linear energetic cutters to make linear cuts through the downhole tubing;

wherein each of the plurality of radial energetic cutters and the plurality of linear energetic cutters comprises deflagrating energetic material and/or detonating energetic material.

11. The method of claim 10, wherein generating radial cuts through the downhole tubing further comprises generating a 360 degree radial cut through the downhole tubing.

12. The method of claim 10, wherein generating linear cuts through the downhole tubing further comprises generating linear cuts along a longitudinal length of the downhole tubing.

13. The method of claim 10, wherein severing the downhole tubing at a position of interest defines an upper portion of the downhole tubing that extends towards a surface of the well and a lower portion of the downhole tubing that extends towards a toe of the well;

wherein a bottom end of the upper portion is spaced from a top end of the lower portion;

wherein the method further comprises setting a concrete plug at the position of interest without removing the upper portion of the downhole tubing from the well.

14. The method of claim 10, wherein the radial and linear cuts generate a window in the downhole tubing at a position of interest.

15. A system, comprising:

a tubing removal gun assembly for severing downhole tubing to form a plurality of tubing strips, wherein the tubing removal gun assembly comprises a plurality of tubing removal guns, wherein each of the plurality of tubing removal guns comprises:

a first radial energetic cutter positioned at a first end of the carrier housing and configured to make a first radial cut in the downhole tubing;

a second radial energetic cutter positioned at a second end of the carrier housing and spaced from the first radial energetic cutter by a predetermined amount; wherein the second radial energetic cutter is configured to make a second radial cut in the downhole tubing; and a plurality of linear energetic cutters positioned within the carrier housing between the first and second radial energetic cutters and configured to make a plurality of longitudinal cuts in the downhole tubing;

wherein each of the first radial energetic cutter and the second radial energetic cutter comprises deflagrating energetic material and/or detonating energetic material; and wherein the tubing strips have a length that is associated with the predetermined amount.

16. The system of claim 15, wherein the first and second radial energetic cutters are comprised of jet cutters.

17. The system of claim 15, wherein the plurality of linear energetic cutters are coupled together using a detonating cord.

* * * * *